United States Patent [19]

Stewart

[11] 4,289,204

[45] Sep. 15, 1981

[54] SOLAR HEAT TREATING OF WELL FLUIDS

[75] Inventor: Orvel L. Stewart, Ardmore, Okla.

[73] Assignee: Sun Tech Energy Corporation, Oklahoma City, Okla.

[21] Appl. No.: 35,494

[22] Filed: May 3, 1979

[51] Int. Cl.[3] ..... E21B 37/00; E21B 43/24

[52] U.S. Cl. ..... 166/303; 137/339; 166/244 C; 166/302; 166/57

[58] Field of Search ..... 166/244 C, 272, 302, 166/303, 57, 75 R; 126/437; 137/13, 334, 339, 340

[56] References Cited

U.S. PATENT DOCUMENTS

| | | | |
|---|---|---|---|
| 1,433,956 | 10/1922 | Knox | 166/267 |
| 1,462,288 | 7/1923 | Knox | 166/267 |
| 1,858,847 | 5/1932 | Young | 166/267 X |
| 2,932,593 | 4/1960 | Millis | 166/302 X |
| 2,958,333 | 11/1960 | Poettmann | 137/13 X |
| 3,269,401 | 8/1966 | Scott et al. | 137/13 |
| 3,294,167 | 12/1966 | Vogel | 166/272 |
| 3,519,006 | 7/1970 | Simon et al. | 137/13 |
| 3,527,692 | 9/1970 | Titus | 137/13 X |
| 4,174,752 | 11/1979 | Slater et al. | 166/272 X |

*Primary Examiner*—Stephen J. Novosad
*Assistant Examiner*—George A. Suchfield
*Attorney, Agent, or Firm*—Laney, Dougherty, Hessin & Beavers

[57] ABSTRACT

Methods and apparatus for treatment of crude oil and well fluids and equipment used in conducting the well fluids. Solar heating means are provided to heat the well fluids to improve the treatment qualities of the fluids. A solar heater is connected to an oil well flow line to remove paraffin and demulsify at the oil well site.

3 Claims, 4 Drawing Figures

SOLAR HEAT TREATING OF WELL FLUIDS

BACKGROUND OF THE INVENTION

1. Field of the Invention

The present invention relates in general to methods and apparatus for treating crude oil and well fluids and equipment used in conducting crude oil and well fluids.

2. Description of the Prior Art

In the field of producing and refining of petroleum oils it is often necessary to provide treatment of the crude oil as it is produced from the ground in order to improve the quality of the oil and to facilitate its transportation. These treatments are required since the crude oil often contains undesirable chemicals or mixtures. Paraffin and other scale-producing elements are one example of these undesirable oil components. During production, paraffin accumulations in the oil-bearing formation as well as in the tubing and pipes which conduct the oil to storage on the surface create a reduced or inefficient output from the well. Another undesirable element in crude oil is entrained water droplets. Water droplets suspended in the oil create an oil and water emulsion reducing the value of the oil and increasing its transportation costs. A common treatment for the problem of paraffin accumulations is a method of circulating chemical solvents into the affected areas to dissolve the buildup. In this method the solvents are pumped into the pipes or formations until the paraffin is redissolved into the solvent. The solvent is then removed and production of the well is resumed. However, this method is expensive and requires that the well be put out of service during the treatment. The common treatment for removal of water droplets suspended in the oil is by heating. This demulsification of the oil and water mixture is often achieved by a continuous heat application process in a tower located at the well site. Demulsification towers of this type are shown in U.S. Pat. Nos. 3,422,028 and 3,029,580. A disadvantage of these towers is that the heat for demulsification is derived from gas or oil and thus consumes a salable product of the well.

SUMMARY OF THE INVENTION

It is accordingly a general object of the present invention to provide an improved method of treating oil well flow lines to remove accumulations of paraffin or the like.

It is also a general object of the present invention to provide improved apparatus and methods for demulsification of oil and water emulsions. More specifically it is an object of the present invention to provide a method and apparatus for demulsifying that is more energy efficient.

It is a further object to provide a method of treating oil well fluids in a more energy efficient manner.

It is also an object of the present invention to provide a method of treating the downhole portions of an oil well for the removal of paraffin or the like such that well production can continue during the treatment process. It is yet a further object to provide such a method which has improved energy efficiency.

Achieving these objects is a method of treating an oil well flow line for the removal of paraffin wherein the well fluid is diverted from the flow line upstream of the portion of the flow line to be treated, the well fluid is heated by a solar heating means, and then the heated well fluid is conducted back to the flow line downstream of the point of diverting and upstream of the portion of the flow line to be treated such that the heated well fluid will flow through the flow line to remove accumulations of paraffin. This method of heating also produces a demulsification of a well fluid comprising an oil and water emulsion when the flow line is connected to a storage tank which allows separation of the heated emulsion.

In an embodiment of the present invention a solar heating means is combined with a conventional demulsifier producing a more energy efficient demulsification. The well fluid is first heated by the solar heating means and then conducted to the conventional demulsifier for further heating to achieve complete demulsification.

In another embodiment downhole portions of a well are treated. A solar heating means is connected to the flow line which transports well fluid from the well. A portion of the well fluid is diverted from the flow line to be heated in the solar heating means. This heated well fluid is then conducted to the oil producing formation for removing the accumulations of paraffin from the formation and the pipe which conducts the fluid to the surface.

For a further understanding of the invention and further objects, features, and advantages thereof, reference may now be had to the following description taken in conjunction with the accompanying drawings.

DESCRIPTION OF THE PREFERRED EMBODIMENTS

Figure 1:
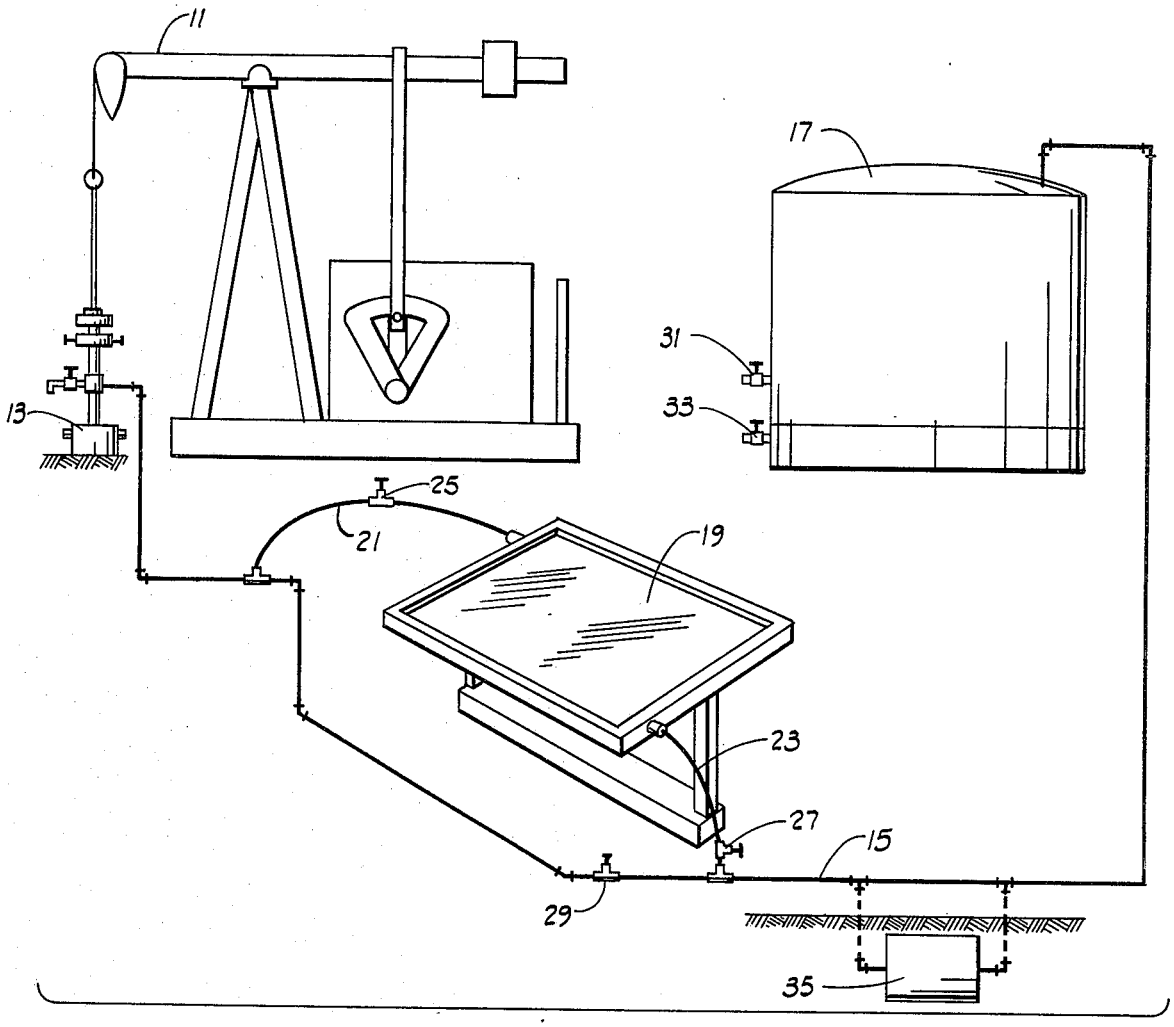
FIG. 1 is a schematic perspective view of an oil well and solar panel connected for practicing a method of the present invention.

Referring now to FIG. 1, a method of treatment in accordance with the present invention will be described. FIG. 1 shows a conventional pumping device 11 for pumping crude oil from a well 13. The crude oil pumped from well 13 travels through a flow line 15 to a storage tank 17. The treatment of the present invention is provided by diverting crude oil through a solar panel heat exchanger 19. Panel 19 is connected to flow line 15 by an inlet pipe 21 and an outlet pipe 23. In order to treat as much of flow line 15 as possible, pipes 21 and 23 connect with flow line 15 near the well 13. Valve 25 on the inlet pipe 21 and valve 27 on the outlet pipe 23 allow regulation of the flow of oil through panel 19. A valve 29 on flow line 15 between the connections of pipe 21 and pipe 23 allows the oil to be diverted through panel 19. From the above it can be seen that if valves 25 and 27 are closed while valve 29 is open, crude oil passes directly from well 13, through flow line 15, to storage tank 17. If valves 25 and 27 are open and valve 29 is closed, the oil from well 13 passes through panel 19 before it continues through flow line 15 to storage tank 17. Diverting the flow of crude oil through panel 19 provides a novel method of demulsifying an oil and water emulsion as well as a novel method of removing paraffin from flow line 15.

Treatment of flow line 15 for removal of paraffin is provided by diverting the crude oil upstream of the portion of the line to be treated, heating the crude oil in solar panel 19, and then returning the crude oil to flow line 15 downstream of the point of diverting but still upstream of the portion to be treated. Since the oil is now heated the paraffin coating on the walls of flow line 15 will be dissolved and production thereby improved.

This method has the further advantage of demulsifying or at least partly demulsifying the oil. As explained above it is well known that heating oil and water emulsions will cause a separation. However, in the past, the heat was applied by a firebox in a tower used especially for demulsification and the heat was provided by combustion of oil or gas. The present invention uses solar heating and the heat is applied immediately as the oil leaves the well. The advantage this provides for demulsification is at least twofold. First, since a solar heat source is used, the cost of heating is dependent on the construction of the panel and not on the cost of hydrocarbon fuel. This advantage becomes increasingly important as petroleum costs rise. Secondly, since demulsification requires an aggregation of the small droplets of suspended water or oil, heating prior to transporting to a storage tank can improve the separation process. The theory of demulsification will be discussed in more detail hereafter. From the foregoing it can be seen that demulsification of oil and water emulsions will be enhanced by the method described.

In the process of demulsification, unlike the flow line treatment occurring by the same process, the variation of the sun as a heat source becomes important. Since nights and cloudy weather cause periodic loss of the heat source, demulsification on a continuous basis raises a problem. The solution to this problem depends on various factors. Among these are the amount of heat required, the amount of heat available from the solar panel in worse case conditions, and the availability of unsalable natural gas at the well site.

One material for storage of heat from the solar panel for use during the absence of solar rays, is the oil itself. Thus if solar panel 19 can provide sufficient heat, and storage tank 17 is sufficiently large and well insulated, no other heat source or heating device will be necessary. During periods when solar heat is available the oil in flow line 15 is heated beyond that required for demulsification. This correspondingly raises the temperature of tank 17 beyond the temperature required for demulsification. During nights or other periods when the solar heating is unavailable, the heat stored in tank 17 heats the unheated incoming oil to allow demulsification to continue. As long as the temperature of the tank does not drop to low, demulsification can continue. In order to prevent the loss of heat, or the passage of oil through the tank without heating, the inlet on tank 17 should be located away from the outlet for oil 31 and the outlet for water 33. In this maner a thorough mixing of the oil entering tank 17 is achieved.

As indicated above, the placement of the heat source outside the tank can be an advantage. This advantage is derived from the relationship between temperature and the process of demulsification. Demulsification becomes increasingly difficult as the size of the entrained droplets decrease. Temperature increases improve demulsification by creating a lower viscosity which, in turn, allows accumulation of larger droplets. These larger droplets are then able to settle faster due to differences in specific gravity. The placement of the heater outside the tank is important due to the cyclical nature of the solar heating processes. If the holder is placed inside the tank, zones of oil which were not demulsified would be created during periods when no heat was applied. During periods of heating, a layer of oil surrounding the heater would insulate the heater creating a zone where complete demulsification occurs but leaving the zone of undemulsified oil intact. These zones would continue unheated due to thermal separation of the zones. This thermal separation is at least partially avoided, however, by heating the oil outside the tank. The outside heating spreads the applied heat over a greater volume of oil since there is no layer of oil surrounding the heater to insulate it. Furthermore, heating the oil in flow line 15 prevents overly large droplets of suspended emulsions from forming prior to spreading the oil in tank 17. In this manner the increase in droplet size will occur gradually and precipitation of these droplets through unheated layers in tank 17 can more easily occur. This more evenly spreads the heat through tank 17. Spreading of the heat via an array of inside heaters might also be effective but would be more expensive.

Another method for storing heat for demulsification during absences of solar heat is by combining this invention with a conventional heat storage device shown joined to flow line 15 by dotted lines in FIG. 1. During times when solar heat is available, storage device 35 absorbs heat from the oil which is heated by panel 19 and which passes through device 35. When solar heat is absent, heat is transferred from storage device 35 to the oil as it passes through device 35. In this manner, the temperature of oil entering tank 17 can be kept more nearly constant. There are many types of well known heat storing devices and, therefore, the specific details of device 35 will not be described.

Figure 2:
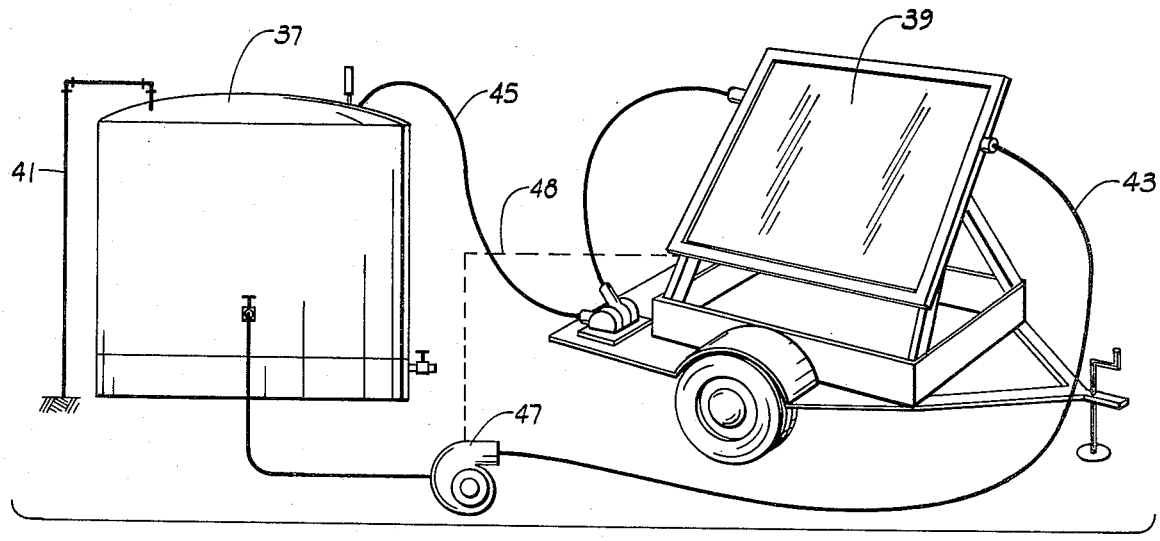
FIG. 2 is a schematic perspective view of a solar panel and tank connected to practice the concepts of the present invention.

Yet another method of dealing with periods of solar heat absence is by circulation of oil from a storage tank to a solar heating panel and back. FIG. 2 shows a tank 37 and a solar heating panel 39 disposed for utilizing this method. This method can be used in combination with the method shown in FIG. 1 or separately. The advantage of this method of demulsification is that the circulation of oil in tank 39 prevents the previously described zone of undemulsified oil from accumulating in the tank.

Describing the process and apparatus shown in FIG. 2 in more detail, the emulsified oil from a well enters tank 37 through pipe 41. Pipe 43 provides a conduit for the oil from tank 37 to solar panel 39. A pipe 45 provides a conduit for the oil from the exit of panel 39 to tank 37. A pump 47 on pipe 43 provides the circulating force to move oil from tank 37 to panel 39, then back to tank 37. From this description, it can be seen that demulsification of the oil in tank 37 is provided by holding the oil in tank 37, circulating the oil through solar panel 39, heating the oil in panel 39 and then returning the oil to tank 37. Complete demulsification of the oil in tank 37 depends mainly on the amount of heat added by the panel 39 and the retention time of the oil in tank 37. An advantage of this method is that the heat from panel 39 is accumulated in the oil retained in tank 37. In this manner, a demulsification over a period of time can occur, the periods of solar heating causing the temperature of the oil to increase until completion of demulsification is achieved. This allows the intermittent heat of the sun to be used to advantage for demulsification.

If desired, pump 39 can be made responsive to the temperature of solar panel 39 such that pumping occurs only when heating of the oil will occur. This prevents unnecessary circulation of the oil. A conventional thermostat located on panel 39 can be used and connected to operate pump 47. This is represented schematically in FIG. 2 by dotted line 48.

Figure 3:
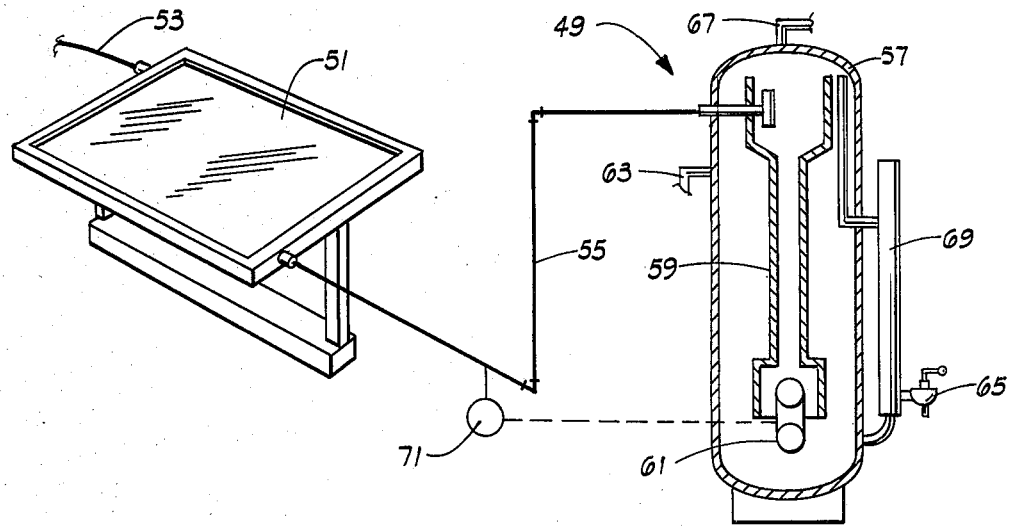
FIG. 3 is a schematic view of an embodiment of the present invention.

If unsalable gas is available or solar heat is not sufficient to provide demulsification, it is useful to combine the concepts of this invention with a conventional tower demulsifier. FIG. 3 shows a conventional tower demulsifier 49 coupled with solar panel 51. Details of the operation of conventional tower demulsifiers are described in U.S. Pat. Nos. 3,029,580 and 3,422,028, the details of which are incorporated herein for details omitted herefrom. Still referring to FIG. 3, oil from a well enters panel 51 through pipe 53. The oil is heated in panel 51. The heated oil is then conducted by pipe 55 from panel 51 into the upper portion of tower 57. The oil then flows downwardly through the tower in a vertical conduit 59. The lower portion of vertical conduit 59 surrounds the upper portion of a firebox 61. Therefore, as the oil flows through the lower portions of vertical conduit 59, it is heated by firebox 61. Firebox 61 is fueled by gas or oil. Due to the heating from firebox 61, the oil and water begin to separate. The oil rises to the upper portions of tower 57 and the water sinks to the lower part of tower 57. A layer of non-separated emulsion usually separates the oil and water. Oil is removed at the top of tower 57 by way of a pipe 63. Water is removed from tower 57 through a pipe 65. A pipe 67 is provided at the extreme upper part of tower 57 for removing gas from tower 57. A specific gravity measuring device 69 on the side of tower 57 and connected to pipe 65 regulates the removal of water from the tower to maintain a constant level of the oil and water interface within tower 57.

If desired, it is useful to make the heat output of the firebox 61 responsive to the temperature of the oil as it leaves panel 51. This conserves the fuel consumed by firebox 61 and prevents overheating of the oil. A thermostat 71 placed in the path of the oil passing from panel 51 to firebox 61 and connected to control the heat output of firebox 61 produces this result.

Figure 4:
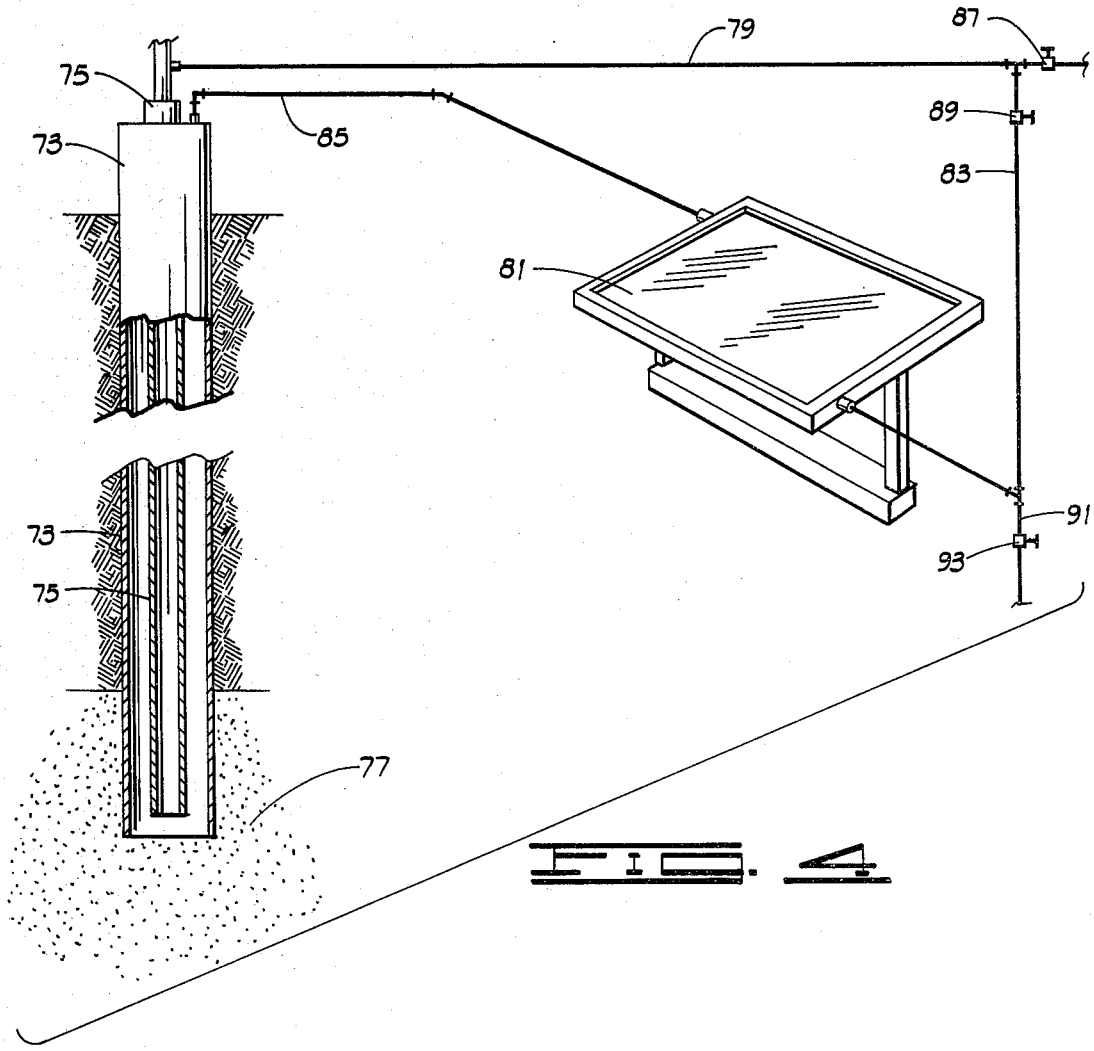
FIG. 4 is a schematic view of another embodiment of the present invention.

Another useful application of the concepts of this invention is in downhole treatments. The underground conduits and oil bearing formation, like flow line 15 of FIG. 1, often accumulate deposits of paraffin or the like. These accumulations slow production by increasing pressure drop across the formation and through the pipe to the surface. FIG. 4 is a schematic representation showing a well with a casing 73. A pipe 75 through which oil is pumped to the surface is contained inside casing 73. Pipe 75 and casing 73 extend from the surface to an oil-bearing formation 77. During production, oil from formation 77 migrates through the porous rock into the area around pipe 75. The oil is then pumped to the surface where it is conducted to a storage tank through flow line 79. Over a period of time paraffin and other deposits accumulate on the interior of the pipe 75 and in formation 77, especially in the immediate vicinity of pipe 75.

Applying the principles of the present invention to these downhole accumulations, a solar panel 81 is connected for heating liquid circulated from flow line 79 into the conduit formed by the interior of casing 73 and the exterior of pipe 75. Pipe 83 connects flow line 79 to solar panel 81 and pipe 85 connects solar panel 81 to the conduit between casing 78 and pipe 75. A valve 87 on flow line 79, downstream of the pipe 83 connection, allows the flow of oil to the storage tank to be decreased or halted. A valve 89 on pipe 83 allows the flow of oil to solar panel 81 to be regulated.

In operation, as valve 89 is opened and valve 87 is closed, the flow of oil to the storage tank through flow line 79 is diverted into pipe 83 and then to solar panel 81 where it is heated. It is then conducted by pipe 85 into the conduit formed between casing 73 and pipe 75. The heated oil then flows down to the lower opening of the pipe 75 where it is pumped back to flow line 79 through the interior of pipe 75. As the circulation continues the heating of the oil causes the accumulations of paraffin and the like to be dissolved in the heated oil. Since the circulation extends into the area of formation 77 immediately surrounding the pipe 75, the accumulations of paraffin located there, as well as those in pipe 75, are reduced. An advantage of this method is that production of the well does not have to cease. Regulating valve 87 and 89 allows the amount of oil heated and recirculated to be determined while production continues. Of course, if a greater amount of oil is recirculated, then a greater heating and hence better treating will result.

If desired the oil can be replaced or supplemented with a treating fluid. This fluid can be introduced into pipe 83 by an entrance pipe 91 having a valve 93. Circulation of the treating fluid proceeds in the same manner as the circulation of heated oil.

A feature in each of the above embodiments is a solar panel. Another term for solar panel is a solar heat exchanger or solar heat exchanger panel. As used herein, these terms refer to any device capable of converting solar energy into heat for heating a liquid conducted through the panel. Many devices fit this definition, and choosing among them for pressure drop, heating ability, and other features is dependent on the results desired for each particular location and embodiment.

The foregoing disclosure and showings made in the drawings are merely illustrative of the principles of this invention and are not to be interpreted in a limiting sense.

What is claimed is:

1. A method of treating an oil well flow line that conducts well fluids for removing paraffin from the flow line, comprising the steps of:

a. diverting the well fluids from the flow line at a location upstream of the portion of the flow line to be treated;

b. heating the diverted well fluids by solar heating means; and c. returning the heated well fluids to the flow line upstream of the portion of the flow line to be treated and downstream of the point of diverting.

2. The method of claim 1 which further includes the step of:

storing heat transferred to the well fluids by a thermal storage device for heating well fluids passing therethrough when said solar heating means is transfering less heat.

3. A method of treating a downhole portion of an oil well of the type having a pipe through which well fluids are pumped which extends from an oil-producing formation to the surface, a casing surrounding the pipe which also extends from the oil-producing formation to the surface, and a flow line connected to the surface end of the pipe and through which the well fluids are transported away from the well, the method comprising the steps of:

a. diverting a portion of the well fluid being transported through the flow line into a solar heating means;

b. heating the diverted fluid in the solar heating means;

c. conducting the heated fluid to the conduit formed between the casing and the pipe; and d. regulating the pressure in the flow line and the conduit such that the heated fluid circulates through the conduit to the oil-producing formation.

* * * * *